US008425740B2

(12) United States Patent
Sasaki et al.

(10) Patent No.: US 8,425,740 B2
(45) Date of Patent: Apr. 23, 2013

(54) CATHODE FOR HYDROGEN GENERATION AND METHOD FOR PRODUCING THE SAME

(75) Inventors: Takeaki Sasaki, Tokyo (JP); Akiyasu Funakawa, Tokyo (JP); Tadashi Matsushita, Tokyo (JP); Toshinori Hachiya, Tokyo (JP)

(73) Assignee: Asahi Kasei Chemicals Corporation, Tokyo (JP)

( * ) Notice: Subject to any disclaimer, the term of this patent is extended or adjusted under 35 U.S.C. 154(b) by 139 days.

(21) Appl. No.: 12/999,453

(22) PCT Filed: Jul. 2, 2009

(86) PCT No.: PCT/JP2009/062146

§ 371 (c)(1),
(2), (4) Date: Dec. 16, 2010

(87) PCT Pub. No.: WO2010/001971

PCT Pub. Date: Jan. 7, 2010

(65) Prior Publication Data

US 2011/0089027 A1 Apr. 21, 2011

(30) Foreign Application Priority Data

Jul. 3, 2008 (JP) ..... 2008-174843
Jul. 3, 2008 (JP) ..... 2008-174855

(51) Int. Cl.
*C25B 11/06* (2006.01)

(52) U.S. Cl.
USPC ..... 204/291; 204/292; 204/293; 204/258; 204/270; 502/101

(58) Field of Classification Search ..... 204/290.03, 204/290.08, 290.09, 290.14, 252, 256, 258, 204/266, 270, 278, 291, 292, 293; 502/101
See application file for complete search history.

(56) References Cited

U.S. PATENT DOCUMENTS

| | | | | |
|---|---|---|---|---|
| 4,797,182 | A | 1/1989 | Beer et al. | |
| 4,941,953 | A | 7/1990 | Matsumoto et al. | |
| 5,128,000 | A | 7/1992 | Klotz et al. | |
| 5,290,415 | A * | 3/1994 | Shimamune et al. | 204/290.09 |
| 5,411,641 | A * | 5/1995 | Trainham et al. | 205/618 |
| 5,868,913 | A * | 2/1999 | Hodgson | 204/298.01 |
| 6,123,816 | A * | 9/2000 | Hodgson | 205/620 |
| 6,231,731 | B1 * | 5/2001 | Kondo et al. | 204/290.03 |
| 6,312,571 | B1 | 11/2001 | Nara et al. | |
| 8,022,004 | B2 * | 9/2011 | Sandoval et al. | 502/101 |
| 2006/0231387 | A1 | 10/2006 | Houda et al. | |
| 2009/0288856 | A1 * | 11/2009 | Sandoval et al. | 174/126.2 |
| 2011/0299225 | A1 * | 12/2011 | Sandoval et al. | 361/509 |

FOREIGN PATENT DOCUMENTS

| | | |
|---|---|---|
| GB | 964631 | 7/1964 |
| JP | 57-13189 | 1/1982 |
| JP | 11-140680 | 5/1999 |
| JP | 11-158678 | 6/1999 |
| JP | 11-302892 | 11/1999 |
| JP | 2000-239882 | 9/2000 |
| JP | 2005-330575 | 12/2005 |
| JP | 2007-146215 | 6/2007 |
| WO | 03/078694 | 9/2003 |

OTHER PUBLICATIONS

Naoki et al., "Characteristics of Plasma-Sprayed NiO Cathode and Mechanism of the Hydrogen Evolution Reaction on it" Proceeding of 20th Soda Industry Technical Symposium, pp. 57-60, 1996.
Soda and Chlorine V5, pp. 129-135, 1994.
International Search Report for PCT/JP2009/062146, mailed Aug. 25, 2009.
China Office Action, dated Dec. 7, 2011 along with an English translation thereof.
Search report from E.P.O., mail date is Mar. 28, 2012.
Taiwanese Office Action issued with respect to counterpart Taiwanese Application No. 098122459, mailed Jan. 24, 2013.

* cited by examiner

*Primary Examiner* — Bruce Bell
(74) *Attorney, Agent, or Firm* — Greenblum & Bernstein, P.L.C.

(57) ABSTRACT

The present invention provides an excellent durable cathode for hydrogen generation, which has a low hydrogen overvoltage and reduced dropping-off of a catalyst layer against the reverse current generated when an electrolyzer is stopped, and a method for producing the same. The present invention provides a cathode for hydrogen generation having a conductive base material and a catalyst layer formed on the conductive base material, wherein the catalyst layer includes crystalline iridium oxide, platinum and iridium-platinum alloy.

10 Claims, 6 Drawing Sheets

CATHODE FOR HYDROGEN GENERATION AND METHOD FOR PRODUCING THE SAME

TECHNICAL FIELD

The present invention relates to a cathode for hydrogen generation used for electrolysis of water or an aqueous solution of an alkali metal compound, in particular, a cathode for hydrogen generation suitably used for electrolysis of salt by an ion-exchange membrane process.

BACKGROUND ART

A cathode for hydrogen generation has been used in electrolysis in which water or an aqueous solution of an alkali metal compound (typically an alkali metal chloride) is electrolyzed to produce hydrogen, chlorine, caustic soda, and the like. The major problem in electrolysis is reduction of energy consumption, more specifically, reduction in electrolytic voltage. In recent years, as an electrolytic process for an aqueous solution of an alkali metal chloride such as salt water, an ion-exchange membrane process is common, and various studies have been carried out now. When electrolysis is carried out, as an electrolytic voltage, in addition to a voltage theoretically required for electrolysis of salt, an overvoltage due to anodic reaction (generation of chlorine), an overvoltage due to cathodic reaction (generation of hydrogen), a voltage by resistance of an ion-exchange membrane, and a voltage depending on an interelectrode distance between anode and cathode, are required. Among these voltages, regarding an overvoltage due to electrode reactions, as an anode for chlorine generation, a noble-metal-based electrode, so-called DSA (Dimensionally Stable Anode), has been developed, in which chlorine overvoltage has been greatly reduced even to 50 mV or lower. On the other hand, regarding a cathode associated with hydrogen generation, in recent years, a durable cathode having low hydrogen overvoltage has been demanded from the viewpoint of energy saving. In addition, it is known that when operation of an electrolyzer is stopped, the cathode is exposed to an oxidative atmosphere by the reverse current, and resistance to the oxidative deterioration due to this reverse current has been also demanded. In order to prevent the oxidative deterioration of the cathode, a step of passing weak protection current before stopping the operation of electrolyzer is employed. However, this method of stopping the operation of electrolyzer needs to be improved due to complicated operational procedures and cost increase in ancillary facilities, and the like. Therefore, a cathode, which can be stopped without passing protection current in stopping the operation of electrolyzer, has been demanded.

As a cathode for hydrogen generation, soft steel, stainless steel and nickel has been used, and activation of the surface of these metals to reduce hydrogen overvoltage has been studied, and many patent applications filed. A typical catalyst layer of a hydrogen generation cathode includes nickel, nickel oxide, nickel-tin alloy, a combination of activated charcoal and oxides, ruthenium oxide, platinum, and the like. In addition, a method for producing a cathode for hydrogen generation may include alloy plating, dispersion/composite plating, thermal decomposition, thermal spraying, and combinations thereof, and the like.

A cathode for hydrogen generation, in which a nickel oxide layer has been formed on a nickel base material by plasma spraying fine particles of granulated nickel oxide, has been developed and used (Non-Patent Document 1). This cathode has a feature that is very resistant to the oxidative deterioration due to electric current because the catalyst itself is an oxide, and does not require a protection current when operation of the electrolyzer is stopped.

As described in Non-Patent Document 2, dispersion plating in which Raney nickel and a hydrogen storing alloy are combined has been used. Raney nickel can realize a low hydrogen overvoltage because it has a very large effective area. Though Raney nickel has an oxidation-labile property, preventing oxidation caused by the reverse current generated when operation of the electrolyzer is stopped by introducing the hydrogen storing alloy has been carried out.

As a cathode using a noble metal, a cathode composed of ruthenium oxide has been proposed, which has a very low hydrogen overvoltage as a cathode for hydrogen generation in an aqueous solution of an alkali metal. However, it is known that ruthenium oxide is subjected to an oxidative degradation by reverse current, and therefore, it is necessary that the protection current is passed when operation of the electrolyzer is stopped.

Patent Document 1 describes that durability of an electrode can be improved by forming an electrode catalyst layer including mainly ruthenium on a metal base material, and further forming a porous protective layer having low activity on the surface thereof.

Forming an electrode catalyst layer having a coating composed of ruthenium oxide, nickel and a rare earth metal having hydrogen storing ability, which was formed by thermal decomposition method, has been also proposed. By introducing the hydrogen storing alloy, preventing oxidation caused by the reverse current generated when operation of the electrolysis is stopped (Patent Document 2).

Since platinum is an electrochemically stable material having a low hydrogen overvoltage, a cathode having a low hydrogen overvoltage by supporting platinum in the catalyst layer has been proposed. However, a cathode for hydrogen generation using only platinum has a problem in durability because platinum physically drops off during electrolysis. Further, it is also a serious problem that the cathode is easily poisoned by Fe ion included in the electrolytic solution leading to a rise in electrolytic voltage.

In Patent Document 3, a cathode for hydrogen generation composed of platinum and cerium oxide has been proposed. In Patent Document 4, a cathode for hydrogen generation composed of platinum-nickel alloy has been proposed. Both of these cathodes exhibit superior performances as a cathode for hydrogen generation in an aqueous solution of alkali metal, but further studies are being carried out in order to improve on the cost.

In Patent Document 5, a cathode for hydrogen generation composed of platinum and iridium oxide has been proposed. However, because of a low degree in crystallinity of iridium oxide and insufficient durability against reverse current, this cathode for hydrogen generation has not been industrialized.

As mentioned above, many approaches have been studied, and various cathodes for hydrogen generation have been proposed for the purpose of reducing power consumption. However, a cathode for hydrogen generation having a low hydrogen overvoltage and sufficient durability against the reverse current and Fe impurities in the electrolytic solution, and further resistance against the reverse current when electrolysis is stopped, has not yet been realized.

PRIOR ART DOCUMENTS

Patent Documents

Patent Document 1: JP-A-11-140680;
Patent Document 2: JP-A-11-158678;

Patent Document 3: JP-A-2000-239882;
Patent Document 4: JP-A-2005-330575;
Patent Document 5: JP-A-57-13189;

Non-Patent Documents

Non-Patent Document 1: Proceeding of 20th Soda Industry Technical Symposium, p. 57 (1996);
Non-Patent Document 2: Soda and Chlorine V5, p. 129 (1994).

SUMMARY OF INVENTION

Problem to be Solved by the Invention

The problem of the present invention is to provide an excellent durable cathode for hydrogen generation, which has low hydrogen overvoltage and reduced drop-off of a catalyst layer against the reverse current generated when operation of the electrolyzer is stopped, and a method for producing the same.

Means for Solving the Problem

The present inventors have intensively studied the above-described problem, and as a result, have found that iridium oxide is an electrochemically stable material which does not show dissolution nor any structural change in the voltage range from the hydrogen generation voltage to the oxygen generation voltage. In addition, the present inventors have also found that the physical dropping-off by electrolysis can be inhibited by using iridium oxide as a framework and supporting platinum thereon in comparison with the cathode for hydrogen generation using platinum alone, and further that the physical dropping-off can be further prevented by improving degree of crystallinity of iridium oxide as a framework. Further, the inventors have found that bond between iridium oxide particles as a framework can be strengthened by forming an alloy of iridium and platinum. Furthermore, the inventors have further found that a cathode for hydrogen generation formed by using the above-described materials has low hydrogen overvoltage, resistance against reverse current generated when operation of the electrolyzer is stopped and Fe ion included in the electrolytic solution, as well as being superior economically. That is, the present invention is as follows.

(1) A cathode for hydrogen generation having a conductive base material and a catalyst layer formed on said conductive base material, wherein the catalyst layer includes crystalline iridium oxide, platinum and iridium-platinum alloy.

(2) The cathode for hydrogen generation according to the above item (1), wherein, in the X-ray diffraction measurement, the above crystalline iridium oxide gives a diffraction peak which is observed in an angular region including $2\theta=34.70°$ and has a full width at half maximum of 0.47° or less.

(3) The cathode for hydrogen generation according to the above item (1) or (2), wherein a ratio (Pt/(Ir+Pt)) of mole number of the above platinum element to total mole number of iridium element and platinum element present in the above catalyst layer is 20 to 50% by atom.

(4) An electrolyzer for electrolysis of an alkali metal chloride, equipped with the cathode for hydrogen generation according to any one of the above items (1) to (3).

(5) A method for producing the cathode for hydrogen generation according to any one of the above items (1) to (3), including:

a coating step to apply an application liquid including an iridium compound and a platinum compound onto the conductive base material;

a film-forming step to form a coated film by drying the application liquid;

a thermal decomposition step to heat the coated film to decompose thermally; and an electrolysis step to electrolyze the coated film after the thermal decomposition.

(6) The method for producing the cathode for hydrogen generation according to any one of the above items (1) to (3), including:

a coating step to apply an application liquid including an iridium compound, a platinum compound, an organic acid having a valence of two or more, and an organic compound having two or more hydroxyl groups subjected to an esterification reaction with the organic acid, onto the conductive base material;

a film-forming step to form a coated film by drying the application liquid; and a thermal decomposition step to heat the coated film to decompose thermally.

(7) The method for producing the cathode for hydrogen generation according to the above item (5) or (6), wherein a ratio (Pt/(Ir+Pt)) of mole number of the platinum element to total mole number of iridium element and platinum element present in the above application liquid is 20 to 50% by atom.

(8) The method for producing the cathode for hydrogen generation according to any one of the above items (5) to (7), a cycle composed of the above coating step, the above film-forming step, and the above thermal decomposition step is repeated two or more times.

(9) The method for producing the cathode for hydrogen generation according to any one of the above items (5) to (8), wherein, in the above thermal decomposition step, the above thermal decomposition is carried out at a temperature of 470° C. or higher and 600° C. or lower.

(10) The method for producing the cathode for hydrogen generation according to any one of the above items (5) to (9), wherein, in the above film-forming step, drying of the above application liquid is carried out at a temperature of 200° C. or lower.

(11) The method for producing the cathode for hydrogen generation according to any one of the above items (5) to (10), wherein, in the above thermal decomposition step, the coated film is subjected to post-heat treatment in an inert gas atmosphere after the above thermal decomposition.

Effect of Invention

According to the present invention, a cathode for hydrogen generation which can be used for electrolysis of an aqueous alkali metal compound solution, in particular, a cathode which can be suitably used for a zero gap electrolyzer, and has a low hydrogen overvoltage, superior durability, resistance against the reverse current generated when operation of the electrolyzer is stopped, and resistance against Fe ion included in the electrolytic solution, is provided.

MODE FOR CARRYING OUT THE INVENTION

Figure 1:
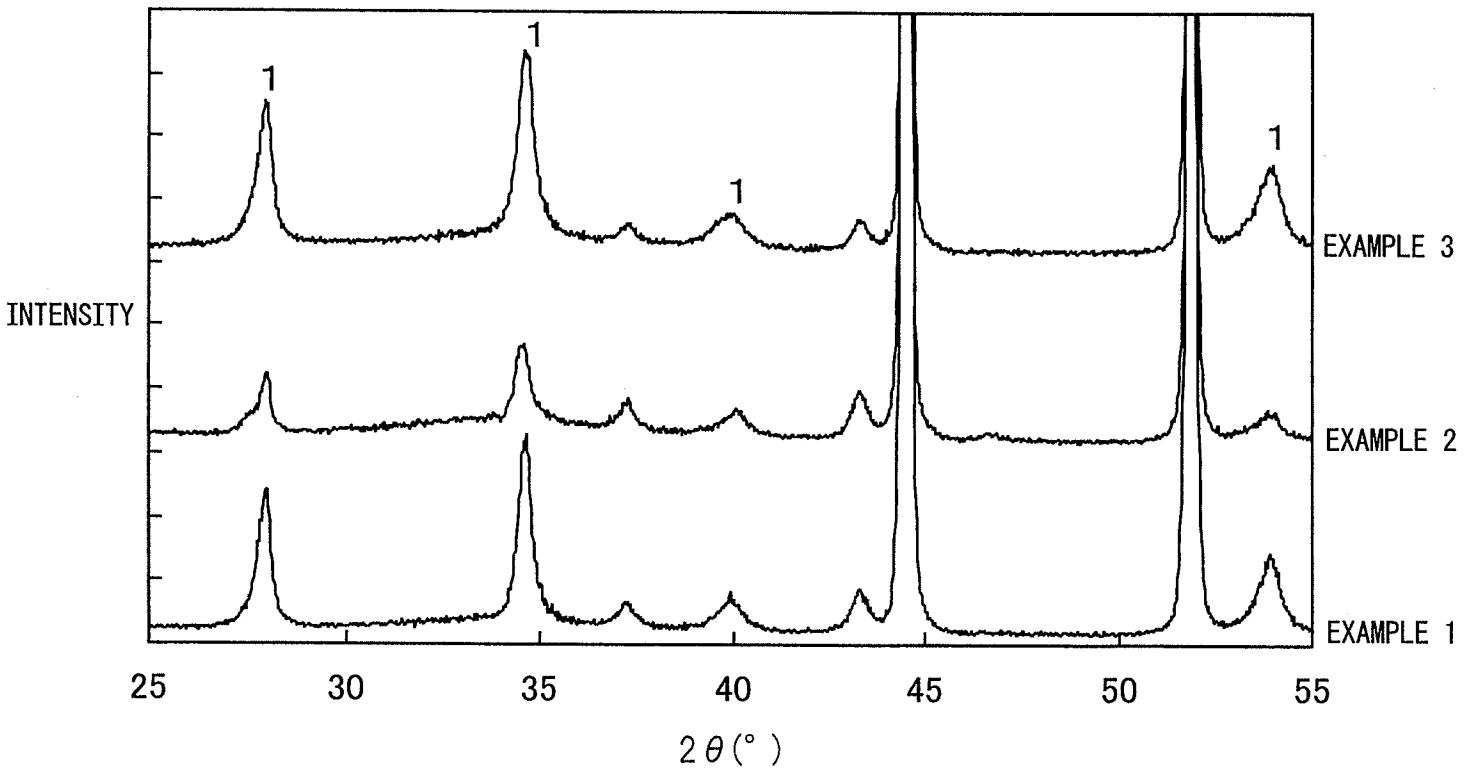
FIG. 1 shows X-ray diffraction patterns before the electrolysis test of the cathodes for hydrogen generation obtained in Examples 1 to 3, the horizontal axis represents diffraction angle ($2\theta$), and the vertical axis represents intensity.

Hereinafter, the present invention will be explained in detail. The present invention provides a cathode for hydrogen generation having a conductive base material and a catalyst layer formed on the conductive base material, wherein the catalyst layer includes crystalline iridium oxide, platinum and iridium-platinum alloy.

The catalyst layer included in the cathode for hydrogen generation of the present invention includes crystalline iridium oxide, platinum and iridium-platinum alloy. In the present invention, the catalyst layer means a layer which is formed on the conductive base material and has a function to reduce hydrogen overvoltage.

To the cathode for hydrogen generation of the present invention, electric current is applied when the cathode is used for electrolysis of an alkali metal compound. When crystalline iridium oxide and platinum are present at electric current application, at least a part of these substances is alloyed by the electric current application. The iridium-platinum alloy, which is formed by alloying of crystalline iridium oxide and platinum, may be present in the catalyst layer at electric current application when the cathode for hydrogen generation is used (including the case when alloying is initiated by electric current application when the cathode is used). Therefore, the above-described iridium-platinum alloy may be formed in advance by electrolysis or the like of the catalyst layer when the cathode for hydrogen generation is produced, or may be formed at electrolysis of an alkali metal compound in use after production of the cathode for hydrogen generation, or may be both of them.

In the catalyst layer of the cathode for hydrogen generation of the present invention, main catalyst components to reduce overvoltage are platinum and iridium-platinum alloy. The catalyst layer has a structure in which the framework is made of crystalline iridium oxide supporting platinum or forming iridium-platinum alloy thereon. Therefore, according to the present invention, even a catalyst having a large surface area and small amount of platinum, a low hydrogen overvoltage can be obtained. It should be noted that, presence of iridium-platinum alloy can be confirmed by a shift of the angle of diffraction peak of metal platinum toward a higher angle side in the X-ray diffraction measurement.

Crystalline iridium oxide in the present invention means iridium oxide which gives a diffraction peak (diffraction line) having the full width at half maximum of 0.47° or less in an angular region including 2θ=34.70°, in the X-ray diffraction measurement using Cu-Kα line as a X-ray source. The full width at half maximum means, as well known to the person skilled in the art of the X-ray diffraction measurement technology, is a width between the angles at which diffraction intensities show a half value of the peak top in a X-ray diffraction peak. As the degree of crystallinity becomes higher, the X-ray diffraction peak becomes sharper and full width at half maximum becomes smaller. Contrary, as the degree of crystallinity becomes lower, full width at half maximum becomes larger.

Platinum in the catalyst layer is preferably amorphous platinum. Electrolysis with the combination of crystalline iridium oxide and amorphous platinum successfully forms iridium-platinum alloy. It should be noted that, amorphous platinum means platinum which does not show any clear platinum peak in the X-ray diffraction.

In the catalyst layer of the cathode for hydrogen generation of the present invention, since the framework is made of iridium oxide, weight reduction of the catalyst layer by electrolysis becomes less and resistance against the reverse current becomes higher as degree of crystallinity of iridium oxide is higher. In crystalline iridium oxide, it is preferable that full width at half maximum in the X-ray diffraction peak of iridium oxide at 2θ=34.70° is 0.47° or less, because weight reduction of the catalyst layer by electrolysis is inhibited and resistance against the reverse current becomes high. In addition, when the full width at half maximum is 0.47° or less, surface area of iridium oxide becomes greater due to high degree of crystallinity of iridium oxide, leading to improved utilization efficiency of platinum. The lower limit of the above-described full width at half maximum is not particularly limited, but the above-described full width at half maximum is preferably 0.10° or more because iridium-platinum alloy is easily formed due to superior dispersing properties of iridium oxide and platinum.

It should be noted that, the X-ray diffraction peak in the present description can be measured more specifically using the X-ray diffractometer (for example, Ultra X18, manufactured by Rigaku Corp.) by Cu-Kα line (λ=1.54184 Å) under the following conditions:

acceleration voltage: 50 kV, acceleration current: 200 mA, scanning axis: 2θ/θ, step interval: 0.02°, scanning speed: 2.0°/minute, and measurement range: 2θ=20 to 60°. In addition, the full width at half maximum can be calculated using the analysis software accompanying to the X-ray diffractometer.

The ratio (Pt/(Ir+Pt)) of mole number of platinum element to total mole number of iridium element and the platinum element present in the catalyst layer is preferably 20 to 50% by atom. When the above-described ratio is 20% by atom or more, a much amount of iridium-platinum alloy is formed by electrolysis, and hence weight reduction of the catalyst layer by electrolysis can be more efficiently inhibited. In addition, when the above-described ratio is 50% by atom or less, an amount of crystalline iridium oxide as a framework can be sufficiently secured, and weight reduction of the catalyst layer by electrolysis can be more efficiently inhibited. The above-described ratio (Pt/(Ir+Pt)) is more preferably 20 to 45% by atom.

The thickness of the catalyst layer is preferably 0.5 to 5 μm, and more preferably 1 to 3 μm. As the thickness of the catalyst layer becomes thicker, a period during which overvoltage can be maintained at a low level becomes longer, but the above-described range is preferable from the viewpoint of the cost.

As the conductive base material, for example, nickel, nickel alloy, stainless steel, and the like can be used. However, since Fe and Cr dissolve out when stainless steel is used in an aqueous alkali solution having high concentration, and that electric conductivity of stainless steel is around 1/10 of that of nickel, nickel is preferable as the conductive base material.

The shape of the conductive base material is not particularly limited, and an appropriate shape can be selected depending on the purpose, i.e., a porous plate, an expanded shape, and so-called a woven mesh which is made by weaving nickel wire, and the like are preferably used. As for the shape of the conductive base material, it is determined based on the distance between anode and cathode in the electrolyzer. If an anode and a cathode have a finite distance, a porous plate or an expanded form is used, and if a zero-gap electrolyzer in which an ion-exchange membrane and an electrode are in contact, a woven mesh of knitted thin wire and the like can be used.

In the present invention, residual stress at the processing is preferably relaxed by annealing the conductive base material in an oxidative atmosphere. In addition, as for the surface of the conductive base material, in order to improve adhesion to the catalyst layer to be coated on the surface, preferably surface area is increased by forming irregularity using steel grid, alumina powder, or the like, thereafter subjecting to an acid treatment.

<Method for Producing the Cathode for Hydrogen Generation>

The cathode for hydrogen generation of the present invention can be produced by any method in which a combination of crystalline iridium oxide and platinum, and/or iridium-platinum alloy which can be formed by alloying thereof can be formed on the conductive base material as the catalyst layer. Specifically, known various processes such as thermal decomposition process, electrolytic plating process, electroless plating process, dispersed plating process, vapor deposition process, plasma spraying process, and the like can be applied. Among them, thermal decomposition process is preferable form the viewpoint of industrial productivity and the like. Hereinafter, the preferable aspects, of producing the cathode for hydrogen generation of the present invention by the thermal decomposition process, will be explained.

The present invention also provides a method for producing the above-described cathode for hydrogen generation of the present invention, comprising:

a coating step to apply an application liquid including an iridium compound, a platinum compound, an organic acid having a valence of two or more, and an organic compound having two or more hydroxyl groups subjected to an esterification reaction with the organic acid, onto the conductive base material;

a film-forming step to form a coated film by drying the application liquid; and a thermal decomposition step to heat the coated film to decompose thermally.

In addition, the present invention also provides a method for producing the above-described cathode for hydrogen generation of the present invention, comprising:

a coating step to apply an application liquid including an iridium compound and a platinum compound, onto the conductive base material;

a film-forming step to form a coated film by drying the application liquid;

a thermal decomposition step to heat the coated film to decompose thermally; and an electrolysis step to electrolyze the coated film after the thermal decomposition.

The application liquid to be used in the method for producing the cathode for hydrogen generation of the present invention is typically a mixture of an iridium compound solution and a platinum compound solution. The iridium compound solution can be exemplified by a solution of chloride, amine complex, nitrate, hydroxide salt, or the like of iridium. The platinum compound solution can be exemplified by a solution of chloride, amine complex, nitrate, hydroxide salt, or the like of platinum. Each of the iridium compound and the platinum compound may be a combination of two or more compounds. The iridium compound solution is preferably an iridium chloride solution from the viewpoint that iridium concentration in the application liquid can be heightened, and the platinum compound solution is preferably a dinitrodiammineplatinum solution. In addition, the solvent solution may be water, an organic solvent, such as alcohol, or a mixture thereof.

In the above-described application liquid, a ratio (Pt/(Ir+Pt)) of mole number of platinum element to total mole number of iridium element and said platinum element is preferably 20 to 50% by atom. When the above-described ratio is 20% by atom or more, a large amount of iridium-platinum alloy is formed by electrolysis, and hence weight reduction of the catalyst layer by electrolysis can be more efficiently inhibited. In addition, when the above-described ratio is 50% by atom or less, an amount of crystalline iridium oxide as a framework can be sufficiently secured, and weight reduction of the catalyst layer by electrolysis can be more efficiently inhibited. The above-described ratio (Pt/(Ir+Pt)) is more preferably 20 to 45% by atom.

The total concentration of iridium element and platinum element present in the application liquid is not particularly limited, but preferably in a range of 10 to 200 g/L, more preferably 50 to 120 g/L, in view of a coating thickness per one coating of the application liquid.

Crystalline iridium oxide and platinum, or iridium-platinum alloy which is formed by alloying these substances in the catalyst layer can be obtained using the application liquid as mentioned above according to the following method (A) or method (B).

Method (A)

An application liquid including an iridium compound and a platinum compound is prepared, and the application liquid is coated on a conductive base material composed of, for example, nickel, nickel alloy, or the like. After a coated film is formed by drying, said coated film is thermally decomposed. This coated film after the thermal decomposition is made up crystalline iridium oxide and platinum (preferably amorphous platinum). By electrolyzing this coated film after thermal decomposition, the iridium-platinum alloy is formed, and therefore, the cathode for hydrogen generation, on which a catalyst layer including at least either of a combination of crystalline iridium oxide and platinum or iridium-platinum alloy has been formed, can be produced. The above-described electrolysis may be carried out upon producing the cathode for hydrogen generation or upon using the cathode for hydrogen generation, i.e., during the electrolysis for hydrogen generation.

Method (B)

The application liquid is prepared by adding an organic acid having a valence of two or more and an organic compound having two or more functional groups (specifically hydroxyl group) subjected to an esterification reaction with the organic acid, and this application liquid is applied onto a conductive base material composed of, for example, nickel, nickel alloy, or the like. After a coated film is formed by drying, the coated film is thermally decomposed. By these procedures, the cathode for hydrogen generation, on which a catalyst layer including at least either of a combination of crystalline iridium oxide and platinum or iridium-platinum alloy has been formed, can be produced.

However, when an organic acid having a valence of two or more or an organic compound having two or more hydroxyl groups subjected to an esterification reaction with said organic acid is used alone, since an amount of the electrode coating (e.g. catalyst layer) is significantly reduced by the reverse current, the effect of the present invention tends to be decreased. Therefore, it is preferable to use an organic acid having a valence of two or more and an organic compound having two or more hydroxyl groups subjected to an esterification reaction with the organic acid, in combination.

The organic acid having a valence of two or more, which can be used in the present invention, typically has a functional group which stabilizes a metal cation by forming a chelate complex with the metal cation. The functional group forming a chelate complex with a metal cation includes, for example, hydroxyl group, carboxyl group and amino group. On the other hand, the organic compound, which can be used in the present invention, having two or more hydroxyl groups subjected to an esterification reaction with the organic acid induces an esterification reaction with a functional group having acidic property in the organic acid, for example, a carboxyl group. In such way, an organic compound having two or more hydroxyl groups subjected to an esterification reaction with organic acid having a valence of two or more and an organic acid having a valence of two or more induce esterification reactions successively to form a polymer. It is considered that an iridium compound and a platinum compound which can be used in the present invention are chelate-coordinated, dispersed and stabilized in this polymer. By thermally decomposing the polymer including these highly dispersed and stabilized iridium compound and platinum compound, production of the electrode catalyst layer having stable crystalline structure including at least either of a combination of crystalline iridium oxide and platinum or iridium-platinum alloy can be realized. In this method, the iridium-platinum alloy is formed in the thermal decomposition step.

In addition, when the application liquid including an organic acid having a valence of two or more and an organic compound having two or more hydroxyl groups subjected to an esterification reaction with said organic acid is used, types of the organic acid and the organic compound are not particularly limited, and any organic acid or organic compound having two or more hydroxyl groups subjected to an esterification reaction with the organic acid can be used.

More specifically, the organic acid having a valence of two or more can be exemplified by, for example, citric acid, isocitric acid, malic acid, tartaric acid, ethylenediamine tetraacetic acid, glycerol, and the like.

The hydroxyl group in the organic compound having two or more hydroxyl groups subjected to an esterification reaction with the organic acid having a valence of two or more may be any one of alcoholic hydroxyl group or phenolic hydroxyl group. More specifically, for example, alcohol having a valence of two or more, ethylene glycol, diethylene glycol, propylene glycol, 1,3-propanediol, 1,2-butanediol, 1,3-butanediol, 1,4-butanediol, 2,3-butanediol, catechol, resorcinol, hydroquinone, and the like, can be exemplified.

In order to sufficiently exert the effect of the present invention, the content of the organic acid having a valence of two or more in the application liquid is preferably in a range of 0.01 to 1.0 in molar ratio when total mole number of iridium and platinum is assumed to be 1. When the molar ratio is 0.01 or more, the effect of the present invention is superior, and when the molar ratio is 1.0 or less, decrease in physical strength due to many voids generated in the catalyst layer can be inhibited. The above-described molar ratio is more preferably in a range of 0.05 to 0.9, and further more preferably in a range of 0.1 to 0.8.

Content of the organic compound having two or more hydroxyl groups subjected to an esterification reaction with the organic acid having a valence of two or more in the application liquid is preferably in a range of 0.01 to 2.0 in molar ratio when total mole number of iridium element and platinum element is assumed to be 1. When the molar ratio is 0.01 or more, the effect of the present invention is superior, and when the molar ratio is 2.0 or less, decrease in physical strength due to many voids generated in the catalyst layer can be inhibited. The above-described molar ratio is more preferably in a range of 0.05 to 1.5, and further more preferably in a range of 0.1 to 1.0.

By either of the above-described method (A) and method (B), the dropping-off of catalyst by electrolysis can be inhibited and high durability can be obtained, because bond between crystalline iridium oxide particles as a framework is strengthened by the formation of iridium-platinum alloy. In addition, by the formation of said alloy, the oxidative deterioration of the catalyst layer by the reverse current generated when operation of the electrolyzer is stopped can be avoided, and a cathode for hydrogen generation which has less dropping-off of catalyst and a high resistance against the reverse current can be obtained.

Next, each step of the method for producing the cathode for hydrogen generation of the present invention will be further explained.

[Coating Step]

In the coating step, the application liquid including an iridium compound and a platinum compound is applied onto the conductive base material. In one aspect, the application liquid includes an organic acid having a valence of two or more and an organic compound having two or more hydroxyl groups subjected to an esterification reaction with said organic acid. As a method for applying the application liquid onto the conductive base material, known various techniques can be employed. A dipping method in which the conductive base material is dipped into the application liquid, a method in which the application liquid is applied onto the conductive base material with a brush, a roll method in which the application liquid impregnated in a sponge roll is applied onto the conductive base material, an electrostatic coating method in which the application liquid and the conductive base material are charged oppositely to each other and the application liquid is atomized using spraying or the like, and the like are suitable. In particular, the roll method and the electrostatic coating method are suitably used from the viewpoints of productivity and capability for uniform coating of the catalyst layer.

[Film-Forming Step]

In the film-forming step, a coated film is formed by drying the above-described application liquid. Drying is preferably carried out at a temperature of 200° C. or lower. When drying temperature exceeds 200° C., the resultant catalyst layer becomes porous because a solvent of the coated application liquid rapidly vaporizes, and the dropping-off during electrolysis tends to become significant. Drying time is not particularly limited, but preferably 5 to 30 minutes.

[Thermal Decomposition Step]

In the thermal decomposition step, the above-described coated film is heated and subjected to thermal decomposition (i.e. calcination). The thermal decomposition can be carried out using an electric furnace, for example, in an air atmosphere. Heating temperature is preferably 470° C. or higher and 600° C. or lower, more preferably 480° C. or higher and 600° C. or lower. For example, since the thermal decomposition temperature of iridium chloride of an example of the iridium compound which can be used in the present invention is around 450° C., at a temperature of 450° C. or lower, thermal decomposition does not proceed well, and the desired iridium oxide does not readily hardly form. Therefore, the heating temperature is preferably 470° C. or higher. On the other hand, at a temperature over 600° C., for example, when a conductive base material composed of nickel or nickel alloy is used, the conductive base material tends to easily soften. Heating time may be any time so long as it is within the time in which thermal decomposition of the coated film is completed, and is preferably around 1 to 60 minutes, and more preferably 5 to 30 minutes.

In the present invention, it is preferable to repeat the cycle composed of the above-described coating step, film-forming step and thermal decomposition step two or more times. In this case, a more uniform catalyst layer can be formed in a desired thickness. In order to form the catalyst layer having a desired thickness, an amount of the application liquid per one application may be increased or concentrations of the iridium compound and the platinum compound may be heightened, but when an excession amount of coating per one application is employed, the catalyst layer sometimes cannot be formed uniformly due to possible unevenness. Therefore, it is preferable to repeat the application, drying and thermal decomposition two or more times. The number of repeating is preferably 3 to 20 times, and more preferably 5 to 15 times.

In the thermal decomposition step, after the above-described procedures up to the thermal decomposition are carried out to form the catalyst layer having a prescribed thickness, the coated film is preferably subjected to a post-heat treatment to complete the thermal decomposition of the coated film. By this treatment, the catalyst layer can be stabilized. The post-heat treatment may be carried out usually in air, but can be carried out in an inert gas atmosphere, if necessary. Temperature of the post-heat treatment is preferably in a range of 350° C. to 600° C., and more preferably in a range of 400° C. to 500° C. Alternatively, it may be the temperature similar to the temperature in the above-described thermal decomposition, i.e., 470 to 600° C.

When the post-heat treatment of the coated film is too short, further thermal decomposition of the coated film tends not to proceed well, and therefore the post-heat treatment is preferably longer. However, from the viewpoint of productivity, the post-heat treatment is preferably 20 minutes to 3 hours, and more preferably 30 minutes to 2 hours.

[Electrolysis Step]

In the electrolysis step, the coated film after the above-described post-heat treatment is electrolyzed. It should be noted that, when an application liquid including an organic acid having a valence of two or more and an organic compound having two or more hydroxyl groups subjected to an esterification reaction with the organic acid is used, this electrolysis step may not be necessarily carried out. The above-described electrolysis step may be carried out as electrolysis for an alkali metal compound at use of the cathode for hydrogen generation. When the electrolysis step is carried out in production of the cathode for hydrogen generation, specific procedures and conditions are exemplified by the conditions that electrolysis is carried out in aqueous caustic soda solution at a current density of 0.1 to 12 kA/m$^2$, during which progression of hydrogen generation from the electrode can be observed. By this electrolysis, iridium-platinum alloy can be formed in the catalyst layer.

By the procedures as mentioned above, the cathode for hydrogen generation, which is suitable for electrolytic use of an aqueous alkali metal chloride solution, and has a low hydrogen overvoltage, a high durability, and further superior resistance against the reverse current when operation of the electrolyzer is stopped, as well as superior resistance against Fe ion in the electrolytic solution, can be produced.

[Electrolyzer for Electrolysis]

The present invention also provides an electrolyzer for electrolysis of water or an alkali metal compound (in particular, alkali metal chloride) equipped with the above-described cathode for hydrogen generation of the present invention. As a constitution of the electrolyzer for electrolysis, the common constitution to those skilled in the art can be employed. The electrolyzer for electrolysis is typically an electrolytic solution, a container holding the electrolytic solution, anode and cathode dipped in electrolytic solution, ion-exchange membrane separating anode chamber and cathode chamber, as well as power source connecting both electrodes, and as the cathode, the cathode for hydrogen generation of the present invention is used. As the electrolytic solution, for example, aqueous sodium chloride solution (salt water), potassium chloride, in the anode chamber, and aqueous sodium hydroxide solution, aqueous potassium hydroxide solution in the cathode chamber, or the like, can be used. As a material for the anode, for example, the material in which ruthenium oxide, iridium oxide and titanium oxide are formed on the titanium base material (so-called DSA), or the like can be used. As the ion-exchange membrane, for example, "Aciplex" (registered TM) F6801 (produced by Asahi Kasei Chemicals Corp.) or the like can be used. In the electrolyzer for electrolysis of the present invention, any device for preventing the reverse current is not required, because it is equipped with the cathode having superior resistance against the reverse current. Therefore, in the electrolyzer for electrolysis of the present invention, electrolysis is easy.

EXAMPLES

The present invention will be further explained based on Examples, but the present invention is not limited to the Examples. Each evaluation was carried out according to the method described below.

(Crystal Structure)

Measurement was carried out using an X-ray diffractometer (Ultra X18, manufactured by Rigaku Corp.) with Cu-Kα line (λ=1.54184 Å) under the following conditions: acceleration voltage: 50 kV, acceleration current: 200 mA, scanning axis: 2θ/θ, step interval: 0.02°, scanning speed: 2.0°/minute, and measurement range: 2θ=20 to 60°.

In order to measure the degree of crystallinity of iridium oxide, a full width at half maximum was calculated from the diffraction peak of iridium oxide ($IrO_2$) at 2θ=34.70°. The value of full width at half maximum was calculated using the analysis software accompanying to the X-ray diffractometer.

In addition, whether iridium-platinum alloy has been formed by the electrolysis or not was identified by confirming whether a peak shifted to a higher angle side from the diffraction position of metal platinum is present or not.

(Salt Electrolysis Test by the Ion-Exchange Membrane Process)

A salt electrolysis test by the ion-exchange membrane process was carried out using a small sized electrolysis cell, to measure hydrogen overvoltage and variation of mass between before and after the test. A test cathode was cut out in the size of 48 mm×58 mm, two holes were made at two positions to fix the cathode on the small-sized electrolysis cell with nickel screw, and the test cathode was fixed on a nickel-made expanded base material. A PFA (tetrafluoroethylene perfluoroalkylvynyl ether copolymer)—covered platinum wire in which about 1 mm of the platinum part has been exposed was fixed in the side facing to the ion-exchange membrane of the cathode face to use as the standard electrode. As the anode, so-called DSA in which ruthenium oxide, iridium oxide and titanium oxide are formed on the titanium base material was used. The electrolysis was carried out in a state in which the anode cell and the cathode cell were separated by holding between the ion-exchange membrane by rubber gaskets made of EPDM (ethylene-propylene-diene). As the ion-exchange membrane, "Aciplex" (registered TM) F4203 (produced by Asahi Kasei Chemicals Corp.) was used. The anode and the ion-exchange membrane were closely stuck, but there was a space of 2 mm between the cathode and the ion-exchange membrane. Concentrations of the solutions in the anode and cathode tanks were adjusted so that the concentration of the salt water in the anode chamber became 205 g/L, and the concentration of sodium hydroxide in the cathode chamber became 32% by weight. In addition, temperatures in the anode and cathode tanks were adjusted so that the temperature in the electrolysis cell became 90° C. Electrolysis was carried out for 1 week while electrolytic current density was maintained constant at 4 kA/$m^2$. Hydrogen overvoltage was determined after 7 days from the initiation of electrolysis by a current interrupter method. Hydrogen overvoltage was measured using a current pulse generator (manufactured by Hokuto Denko Corp., HC114) as a rectifier for electrolysis, by blocking off the current instantaneously, observing the wave pattern by an analyzing recorder or the like, and removing the solution resistance between the reference electrode. Specifically, the hydrogen overvoltage was obtained by subtracting the voltage when current was blocked off instantaneously, which was a voltage based on structural resistance and solution resistance, from a voltage of the test cathode to the reference electrode at 4 kA/$m^2$.

(Reverse Current Resistance Test)

Evaluation of the resistance against the reverse current was carried out according to the following procedures. The test cathode was cut out in 3 cm×3 cm, and fixed to the electrolysis cell with screws made of nickel. After positive electrolysis was carried out in an aqueous solution of 32% by weight of sodium hydroxide at 60° C. and an electrolytic current density of 8 kA/$m^2$ for 72 hours using a platinum plate as a counter electrode so that the test cathode generated hydrogen, reverse electrolysis was carried out at a current density of reverse current of 0.05 kA/$m^2$ for 2 hours, and positive electrolysis was further carried out at an electrolytic current density of 8 kA/$m^2$ for 24 hours. After the test, the test cathode was taken out, rinsed with pure water all day and night, and sufficiently dried at 50° C., then mass was measured. From the difference between this and mass of the cathode before the test, variation of mass between before and after the electrolysis was calculated.

Example 1

As the conductive base material, a woven mesh base material which was made by knitting a nickel fine wire having a diameter of 0.15 mm in a sieve mesh size of 40 was used. The conductive base material was blasted with alumina powder having a weight average particle size of 100 μm or less, then subjected to an acid treatment in 6N hydrochloric acid at room temperature for 5 minutes, followed by rinsing with water and drying.

Subsequently, an application liquid was prepared by mixing a dinitrodiammineplatinum nitric acid solution (produced by Tanaka Kikinzoku Kogyo K.K., platinum concentration: 100 g/L) and an iridium chloride solution (produced by Tanaka Kikinzoku Kogyo K.K., iridium concentration: 100 g/L) so that a molar ratio of platinum to iridium became 0.27:0.73.

A vat including the application liquid was placed in the lowest part of the coating roll, and the application liquid was impregnated into the coating rolls made of EPDM. A roll was placed above the vat so that said roll and the application liquid were in contact at any time, and another roller made of PVC was further placed above the roll. In such way, the application liquid was coated on said conductive base material. Before the application liquid dried, the conductive base material was quickly passed between two sponge rolls made of EPDM to absorb and remove the accumulated application liquid in the intersections of the mesh of the conductive base material. Subsequently, after a coated film was formed by drying at 50° C. for 10 minutes, the coated film was subjected to by calcination at 500° C. for 10 minutes using a Muffle furnace (KM-600, manufactured by Advantech Co., Ltd.) to thermally decompose the coated film. These procedures of coating, drying and thermal decomposition were repeated 12 times, respectively. Furthermore, the conductive base material was subjected to the post-heat treatment in an air atmosphere at 500° C. for 1 hour, to prepare the test cathode.

Figure 2:
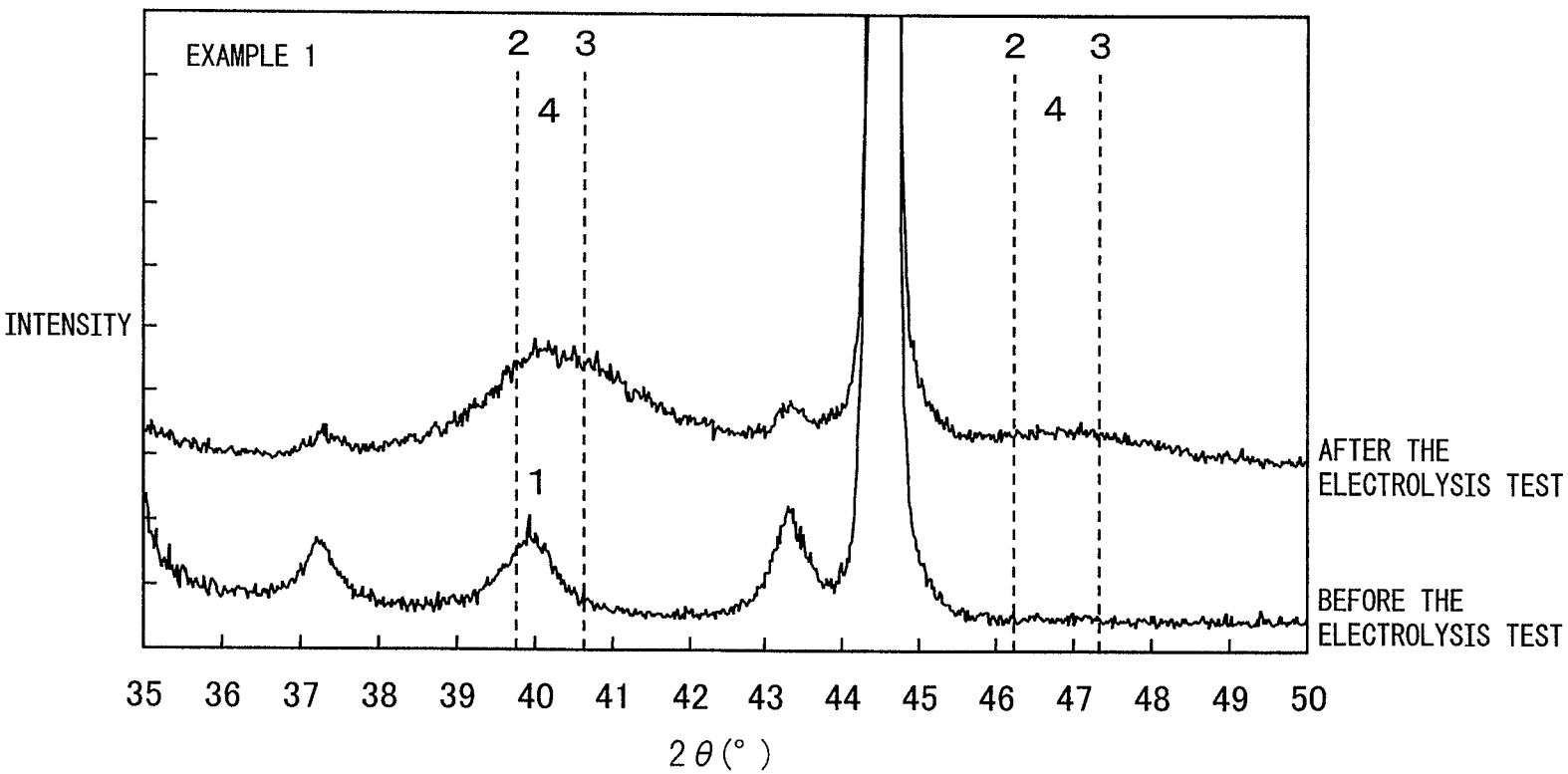
FIG. 2 shows X-ray diffraction patterns before and after the electrolysis test of the cathode obtained in Example 1, the horizontal axis represents diffraction angle (2θ), and the vertical axis represents intensity.

According to the methods described above, X-ray diffraction measurement, salt electrolysis test by the ion-exchange membrane process and reverse current resistance test were carried out. The X-ray diffraction patterns before the salt electrolysis test by the ion-exchange membrane process are shown in FIG. 1, and the X-ray diffraction patterns after the salt electrolysis test by the ion-exchange membrane process are shown in FIG. 2. The results of the salt electrolysis test by the ion-exchange membrane process are shown in Table 1.

In the X-ray diffraction peaks (FIG. 1) before the electrolysis test, peak 1 of iridium oxide can be clearly observed whereas clear peak of metal platinum cannot be observed. From this, it can be understood that the catalyst layer before the electrolysis test is composed of crystalline iridium oxide and amorphous platinum. In addition, the full width at half maximum of the X-ray diffraction peak) ($2\theta$=34.70° of iridium oxide was 0.38°. From the X-ray diffraction peaks (FIG. 2) of the catalyst layer before and after the electrolysis test, in the X-ray diffraction peaks after the electrolysis test, a diffraction peak of iridium-platinum alloy was observed at around $2\theta$=47°, that is the position shifted from angle 2 of the diffraction peak of metal platinum toward the side of peak 3 of the diffraction peak of metal iridium, in other words, higher angle side. From this fact, it was found that iridium-platinum alloy was formed by the electrolysis.

The results of the salt electrolysis test by the aforesaid ion-exchange membrane process are shown in Table 1. The hydrogen overvoltage at 4 kA/$m^2$ was 89 mV, showing that a cathode having a low hydrogen overvoltage was obtained. As a result of the reverse current resistance test, weight loss of the cathode after the test in comparison with the one before the test was 4.0 mg, showing that a cathode having a high resistance against the reverse current was obtained.

Furthermore, using this test cathode, evaluation of resistance against Fe ion in the electrolytic solution was carried out. Evaluation of the resistance against Fe ion was carried out by measuring the interelectrode voltage between anode and cathode using a small-sized cell described below. The test cathode was cut out in a size of longitudinal side 95 mm×traversal side 110 mm, and the edge sections (about 2 mm width each) of 4 sides were subjected to folding at a right angle. A mat knitted with fine nickel wire was placed on an expanded metal current collector made of nickel fixed on the cathode cell, and the mat was covered with the above-described folded test cathode so that the folded parts came to the collector and mat side. Four corners of the test cathode were fixed to the collector with a string made of Teflon (registered TM). As an anode, a so-called DSA in which ruthenium oxide, iridium oxide and titanium oxide were formed on the titanium base material was used. Electrolysis was carried out in such state in which the anode cell and the cathode cell were separated by holding between an ion-exchange membrane by rubber gaskets made of EPDM (ethylene-propylene-diene). As an ion-exchange membrane, "Aciplex" (registered TM) F6801 (produced by Asahi Kasei Chemicals Corp.) was used. Electrolysis was carried out in a state in which the anode, the ion-exchange membrane and the cathode were closely stuck (zero-gap electrolysis). Concentrations of the solutions in the anode and cathode tanks were adjusted so that concentration of the salt water in the anode chamber became 205 g/L and concentration of sodium hydroxide in the cathode chamber became 32% by weight. In addition, the temperatures in the anode and cathode tanks were adjusted so that the temperature in the electrolysis cell became 90° C. After electrolysis was carried out at an electrolytic current density of 6 kA/$m^2$ for 7 days, concentration of Fe ion in the cathode chamber was adjusted so as to become 1 ppm by adding ferric chloride into the cathode chamber, and electrolysis was continued for further 90 days. In order to compare the effect of Fe ion, electrolysis was carried out at the same time using another small-sized cell under the same conditions, except that ferric chloride was not added into the cathode chamber. Concentration of Fe ion in the cathode chamber when ferric chloride was not added was 0.1 ppm or less. Providing that the pair to pair voltage difference between both cells right before the addition of Fe ion was 0, the pair to pair voltage difference between both cells after continuation of electrolysis for 90 days was 6 mV. From this result, it is clear that the test cathode was not influenced by Fe ion.

Example 2

An electrode was prepared and evaluated in the same way as in Example 1, except that an application liquid was prepared by mixing a dinitrodiammineplatinum nitric acid solution (produced by Tanaka Kikinzoku Kogyo K.K., platinum concentration: 100 g/L) and an iridium chloride solution (produced by Tanaka Kikinzoku Kogyo K.K., iridium concentration: 100 g/L) so that a molar ratio of platinum to iridium became 0.4:0.6.

In the X-ray diffraction peaks before the electrolysis test (FIG. 1), the peak of iridium oxide can be clearly observed whereas a clear peak of metal platinum cannot be observed. From this, it can be understood that the catalyst layer before the electrolysis test is composed of crystalline iridium oxide and amorphous platinum. In addition, the full width at half maximum of the X-ray diffraction peak) (2θ=34.70° of iridium oxide was 0.42°. Similarly to in Example 1, it can be understood that iridium-platinum alloy had been formed from the X-ray diffraction peaks after the electrolysis test.

As shown in Table 1, as a result of the salt electrolysis test by the ion-exchange membrane process, the hydrogen overvoltage at 4 kA/$m^2$ was 92 mV, showing that a cathode having a low hydrogen overvoltage was obtained. As a result of the reverse current resistance test, weight loss after the test in comparison with the one before the test was 4.7 mg, showing that a cathode having a high resistance against the reverse current was obtained.

Example 3

A cathode was prepared and evaluated in the same way as in Example 1, except that the cathode was subjected to the thermal decomposition at 470° C. for 10 minutes, and further subjected to the post-heat treatment at 470° C. for 1 hour after the thermal decomposition.

In the X-ray diffraction peak (FIG. 1) before the electrolysis test, the clear peak of iridium oxide can be observed whereas a clear peak of metal platinum cannot be observed. From this, it can be understood that the catalyst layer before the electrolysis test is composed of crystalline iridium oxide and amorphous platinum. In addition, full width at half maximum of the X-ray diffraction peak (2θ=34.70° of iridium oxide was 0.46°. Furthermore, similarly to as in Example 1, it can be understood that iridium-platinum alloy had been formed from the X-ray diffraction peaks after the electrolysis test.

As shown in Table 1, as a result of the salt electrolysis test by the ion-exchange membrane process, the hydrogen overvoltage at 4 kA/$m^2$ was 90 mV, and a cathode having a low hydrogen overvoltage was obtained. As a result of the reverse current resistance test, weight loss after the test in comparison with the one before the test was 4.8 mg, and a cathode having a high resistance against the reverse current was obtained.

Example 4

As a conductive base material, a woven mesh base material which was made by knitting a nickel fine wire having a diameter of 0.15 mm in sieve mesh size of 40 mesh was used. The base material was blasted with alumina powder having a weight average particle size of 100 μm or less. After that, the base material was subjected to etching by dipping into 6N hydrochloric acid for 5 minutes, followed by rinsing with water and drying.

A solution was prepared using a chloroiridic acid solution (produced by Tanaka Kikinzoku Kogyo K.K.) having an iridium concentration of 100 g/L and a dinitrodiammineplatinum nitric acid solution (produced by Tanaka Kikinzoku Kogyo K.K.) having a platinum concentration of 100 g/L so that a molar ratio of iridium to platinum included in the application liquid became 0.73:0.27. After that, when the total mole number of iridium and platinum was assumed to be 1, citric acid monohydrate of an amount corresponding to a molar ratio of 0.36 and ethylene glycol of an amount corresponding to 0.72 were added thereto, respectively, to obtain an application liquid.

A vat including the application liquid was placed in the lowest part of the coating roll, and the application liquid was impregnated into the coating rolls made of EPDM. A roll was placed above the vat so that said roll and the application liquid were in contact at any time, and another roller made of PVC was further placed above said roll. In such way, the application liquid was coated on the conductive base material. Before the application liquid dried, the conductive base material was quickly passed between two sponge rolls made of EPDM to absorb and remove the accumulated application liquid in the intersections of the mesh of the conductive base material. Subsequently, after a coated film was formed by drying at 150° C. for 10 minutes, said coated film was subjected to heating at 500° C. for 10 minutes using a Muffle furnace (KM-600, manufactured by Advantech Co., Ltd.) to thermally decompose said coated film. These procedures of coating, drying and thermal decomposition were repeated 12 times, respectively. Furthermore, the conductive base material was subjected to the post-heat treatment in an air atmosphere at 500° C. for 1 hour, to prepare the test cathode.

The results of the salt electrolysis test by the ion-exchange membrane process using this cathode are shown in Table 1. As shown in Table 1, a cathode having a low hydrogen overvoltage was obtained.

Figure 3:
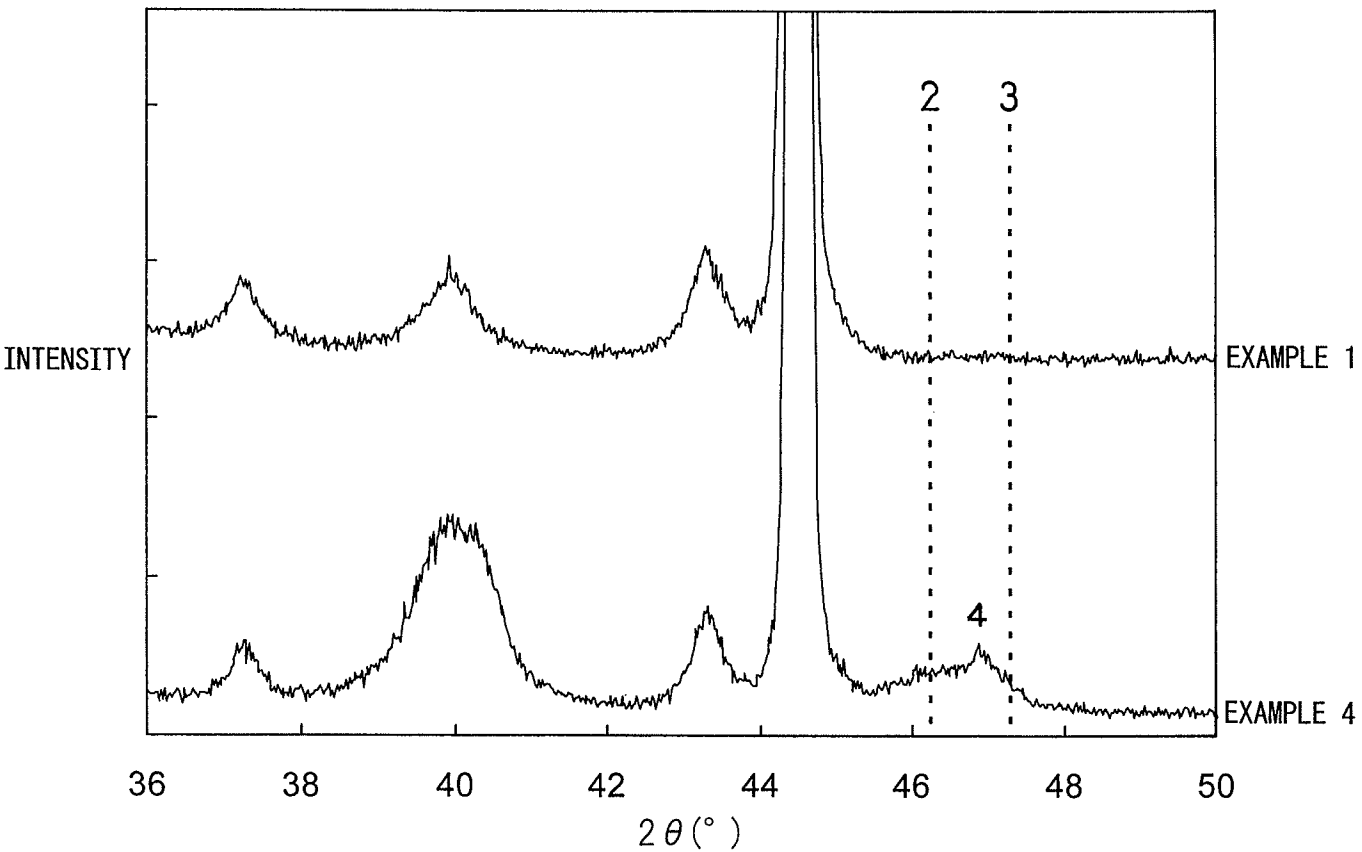
FIG. 3 shows X-ray diffraction patterns before the electrolysis test of the cathodes for hydrogen generation obtained in Examples 1 and Example 4, the horizontal axis represents diffraction angle (2θ), and the vertical axis represents intensity.

The X-ray diffraction pattern of the test cathode measured before the salt electrolysis test by the ion-exchange membrane process is shown in FIG. 3. A diffraction peak 4 of iridium-platinum alloy was observed around 2θ=47°, that is the position shifted from angle 2 of the diffraction peak of metal platinum toward the side of peak 3 of the diffraction peak of metal iridium, that is, higher angle side. It can be understood that iridium-platinum alloy had been formed since before the energization in the cathode prepared in this Example. In addition, the full width at half maximum of the X-ray diffraction peak of iridium oxide)(2θ=34.70° was 0.37°.

Figure 4:
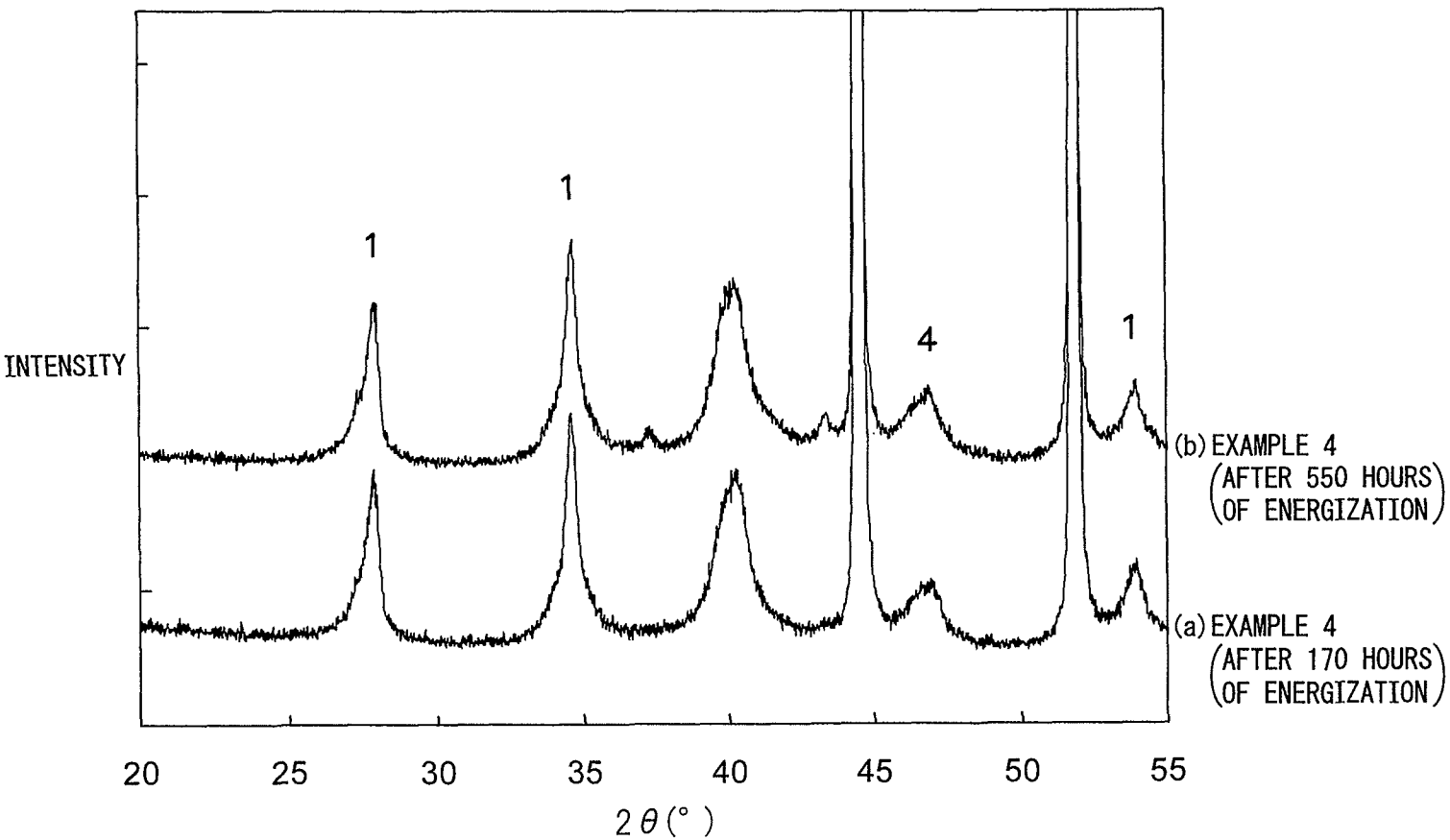
FIG. 4 shows X-ray diffraction patterns after the electrolysis test (after 170 hours and 550 hours of energization) of the cathode for hydrogen generation obtained in Example 4, the horizontal axis represents diffraction angle (2θ), and the vertical axis represents intensity.

Next, the X-ray diffraction patterns of the test cathode measured after the salt electrolysis test by the ion-exchange membrane process are shown in FIGS. 4 (*a*) and (*b*). The diffraction pattern (a) and (b) show those after electrolyzing times of 170 hours and 550 hours, respectively. Regardless of the electrolyzing time, intensities of the diffraction lines of iridium oxide and intensities of the diffraction lines of iridium-platinum alloy did not change.

As shown in Table 1, as a result of the salt electrolysis test by the ion-exchange membrane process, the hydrogen overvoltage at 4 kA/m$^2$ was 91 mV, and a cathode having a low hydrogen overvoltage was obtained. As a result of the reverse current resistance test, weight loss after the test in comparison with the one before the test was 3.0 mg, and a cathode having a high resistance against the reverse current was obtained. In this Example, a cathode which has a low overvoltage and a stable crystalline structure of the catalyst layer even after a long period of energization was obtained.

Example 5

A solution was prepared using a chloroiridic acid solution having an iridium concentration of 100 g/L and a dinitrodiammineplatinum nitric acid solution having a platinum concentration of 100 g/L so that a molar ratio of iridium to platinum became 0.73:0.27. After that, citric acid in an amount corresponding to a molar ratio of 0.36 and ethylene glycol in an amount corresponding to a molar ratio of 0.72 were added thereto, respectively, when the total mole number of iridium and platinum was assumed to be 1. Using this solution as an application liquid, a Ni-woven mesh base material was coated with the application liquid, then dried at 150° C., followed by thermal decomposition at 500° C. After repeating the cycle of procedures composed of application, drying and thermal decomposition 12 times, the base material was subjected to heating in a nitrogen atmosphere at 500° C. for 60 minutes, to prepare a cathode. The results of the salt electrolysis test by the ion-exchange membrane process using this cathode are shown in Table 1. As shown in Table 1, a cathode having a low hydrogen overvoltage was obtained in this Example.

The full width at half maximum of the X-ray diffraction peak of iridium oxide) (2θ=34.70° in the X-ray diffraction peak before the electrolysis test was 0.38°. Furthermore, similarly to in Example 4, it can be understood that iridium-platinum alloy had been formed from the X-ray diffraction peak before the electrolysis test.

As shown in Table 1, as a result of the salt electrolysis test by the ion-exchange membrane process, the hydrogen overvoltage at 4 kA/m$^2$ was 92 mV, and a cathode having a low hydrogen overvoltage was obtained. As a result of the reverse current resistance test, weight loss of the cathode after the test in comparison with the one before the test was 1.0 mg, andt a cathode having a high resistance against the reverse current was obtained.

Comparative Example 1

A cathode was prepared in the same way as in Example 1, except that only chloroplatinic acid solution (produced by Tanaka Kikinzoku Kogyo K.K., platinum concentration: 100 g/L) was used as an application liquid. By the above-described method, the salt electrolysis test by the ion-exchange membrane process was carried out. The results of the salt electrolysis test by the ion-exchange membrane process are shown in Table 2.

As a result of the salt electrolysis test by the ion-exchange membrane process, the hydrogen overvoltage at 4 kA/m$^2$ was 84 mV. As a result of the reverse current resistance test, weight loss of the cathode after the test in comparison with the one before the test was 7.5 mg, which was great, and it was found that the resistance against the reverse current was not sufficient.

Comparative Example 2

A cathode was prepared and evaluated in the same way as in Example 1, except that only iridium chloride solution (produced by Tanaka Kikinzoku Kogyo K.K., iridium concentration: 100 g/L) was used as an application liquid.

Figure 5:
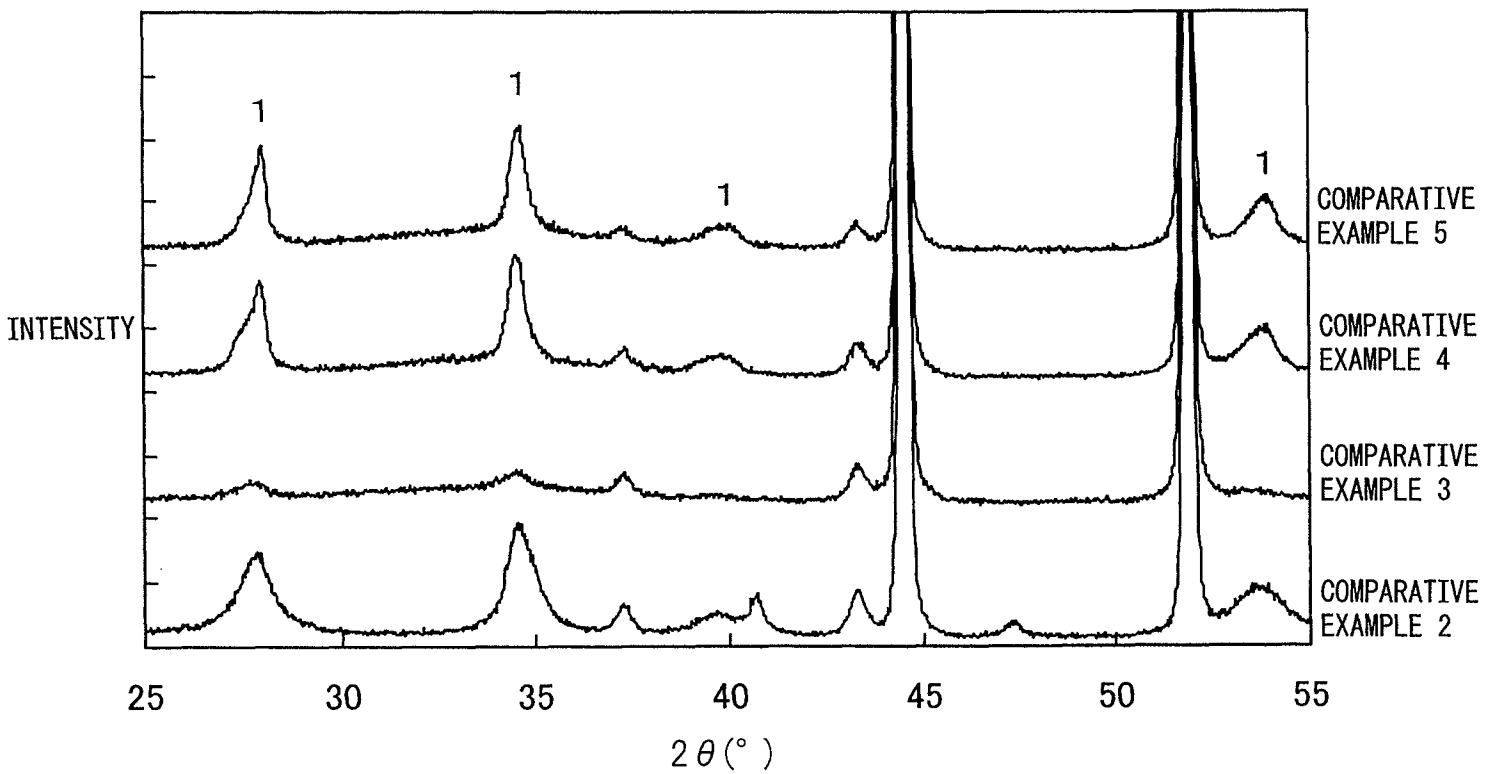
FIG. 5 shows X-ray diffraction patterns before the electrolysis test of the cathodes for hydrogen generation obtained in Comparative Examples 2 to 5, the horizontal axis represents diffraction angle (2θ), and the vertical axis represents intensity.

From the X-ray diffraction peaks (FIG. 5) before the thermal electrolysis test, the full width at half maximum of the X-ray diffraction peak of iridium oxide)(2θ=34.70° was 0.86°.

As shown in Table 2, as a result of the salt electrolysis test by the ion-exchange membrane process, hydrogen overvoltage at 4 kA/m$^2$ was 99 mV. As a result of the reverse current resistance test, weight loss of the cathode after the test in comparison with the one before the test was 10.6 mg. It was found that when the catalyst layer was made only with the iridium chloride solution, weight loss became great and the resistance against the reverse current was not sufficient because of the low degree in crystallinity of iridium oxide.

Comparative Example 3

A cathode was prepared and evaluated in the same way as in Example 1, except that temperatures of the thermal decomposition and the post-heat treatment were changed from 500° C. to 400° C., respectively.

From the X-ray diffraction peaks before the electrolysis test (FIG. 5), the full width at half maximum of the X-ray diffraction peak of iridium oxide) (2θ−34.70° was 0.82°.

As shown in Table 2, as a result of the salt electrolysis test by the ion-exchange membrane process, hydrogen overvoltage at 4 kA/m$^2$ was 89 mV. As a result of the reverse current resistance test, weight loss of the cathode after the test in comparison with the one before the test was 13.2 mg. It was found that weight loss was great and the resistance against the reverse current was not sufficient because of low degree of crystallinity of iridium oxide as a framework.

Comparative Example 4

A cathode was prepared and evaluated in the same way as in Example 1, except that temperatures of the thermal decomposition and the post-heat treatment were changed from 500° C. to 450° C., respectively.

From the X-ray diffraction peaks before the electrolysis test (FIG. 5), the full width at half maximum of the X-ray diffraction peak of iridium oxide) (2θ=34.70° was 0.50°.

As shown in Table 2, as a result of the salt electrolysis test by the ion-exchange membrane process, the hydrogen overvoltage at 4 kA/m$^2$ was 89 mV. As a result of the reverse current resistance test, weight loss of the cathode after the test in comparison with the one before the test was 6.7 mg. It could be understood that weight loss was great and the resistance against the reverse current was not sufficient because of the low degree in crystallinity of iridium oxide as a framework.

Comparative Example 5

A cathode was prepared and evaluated in the same way as in Example 1, except that an application liquid was prepared by mixing a chloroplatinic acid solution (produced by Tanaka Kikinzoku Kogyo K.K., platinum concentration: 100 g/L) and a iridium chloride solution (produced by Tanaka Kikinzoku Kogyo K.K., iridium concentration: 100 g/L) so that a molar ratio of platinum to iridium became 0.39:0.61, and the thermal decomposition and the post-heat treatment after the thermal decomposition were carried out at 450° C. for 10 minutes and 450° C. for 1 hour, respectively.

From the X-ray diffraction peaks before the electrolysis test (FIG. 5), the full width at half maximum of the X-ray diffraction peak of iridium oxide) (2θ=34.70° was 0.49°.

As shown in Table 2, as a result of the salt electrolysis test by the ion-exchange membrane process, the hydrogen overvoltage at 4 kA/m$^2$ was 90 mV. As a result of the reverse current resistance test, weight loss of the cathode after the test in comparison with the one before the test was 6.7 mg. It was found that weight loss was great and the resistance against the reverse current was not sufficient because of the low degree in crystallinity of iridium oxide as a framework.

Comparative Example 6

A cathode was prepared and evaluated in the same way as in Example 1, except that only ruthenium chloride solution (produced by Tanaka Kikinzoku Kogyo K.K., ruthenium concentration: 100 g/L) was used as an application liquid.

As shown in Table 2, as a result of the salt electrolysis test by the ion-exchange membrane process, the hydrogen overvoltage at 4 kA/m$^2$ was 82 mV. As a result of the reverse current resistance test, weight loss of the cathode after the test in comparison with the one before the test was 11.5 mg. It was found that when the catalyst layer was made only with a ruthenium chloride solution, weight loss was great and the resistance against the reverse current was not sufficient.

Example 6

A dinitrodiammineplatinum nitric acid solution (produced by Tanaka Kikinzoku Kogyo K.K., platinum concentration: 100 g/L) and an iridium chloride solution (produced by Tanaka Kikinzoku Kogyo K.K., platinum concentration: 100 g/L) were mixed together so that a molar ratio of platinum to iridium became 0.27:0.73. Cathode were prepared and evaluated in the same way as in Example 1, except that test cathodes having different masses of catalyst layer were made by varying the number of cycle composed of roll coating, drying and thermal decomposition. It should be noted that, similar to Example 1, it was found that iridium-platinum alloy formed from the X-ray diffraction peak after the electrolysis test.

Figure 6:
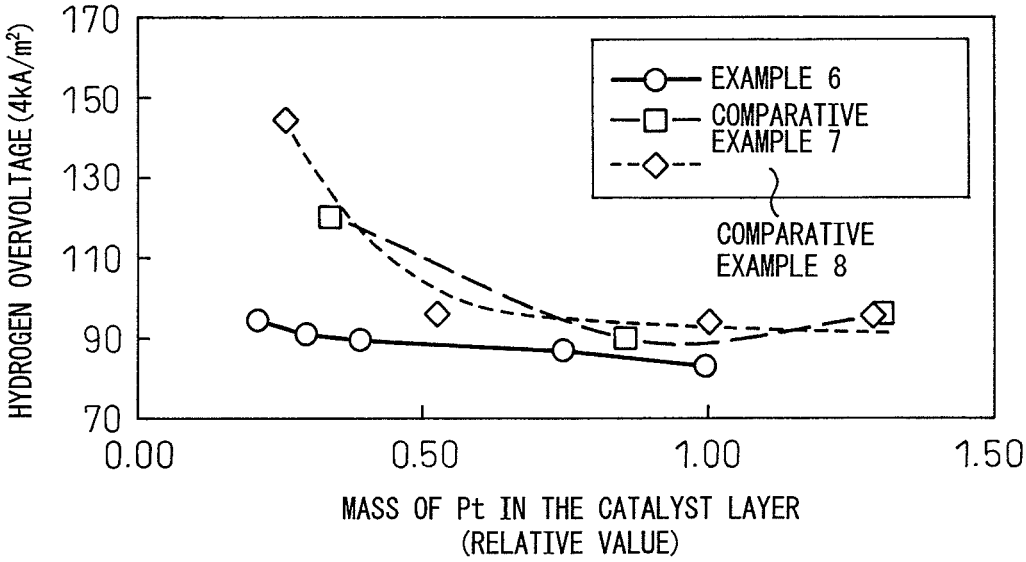
FIG. 6 shows changes of overvoltage of the cathode for hydrogen generation obtained in Example 6 as well as Comparative Examples 7 and 8, the horizontal axis represents relative amount of platinum element mass in the catalyst layer, and the vertical axis represents hydrogen overvoltage.

As shown in FIG. 6, it was found that the cathodes obtained in the present Example showed low hydrogen overvoltage even used amount of platinum is less. It should be noted that, in the plotting in FIG. 6, the horizontal axis represents a relative amount value when mass of platinum element in the catalyst in the rightmost plot in FIG. 6 in Example 6 is assumed to be 1, and the vertical axis represents a hydrogen overvoltage at a current density of 4 kA/m$^2$. Starting from the right in FIG. 6, as relative amount values of platinum element in the catalyst, for Example 6, 1 (hydrogen overvoltage value: 83 mV), 0.75 (hydrogen overvoltage value: 87 mV), 0.39 (hydrogen overvoltage value: 89 mV), 0.30 (hydrogen overvoltage value: 90 mV), and 0.21 (hydrogen overvoltage value: 94 mV) are shown, and for Comparative Example 7 to be described later, 1.31 (hydrogen overvoltage value: 96 mV), 0.86 (hydrogen overvoltage value: 90 mV), and 0.34 (hydrogen overvoltage value: 121 mV) are shown, and for Comparative Example 8 to be described later, 1.29 (hydrogen overvoltage value: 96 mV), 1.01 (hydrogen overvoltage value: 95 mV), 0.53 (hydrogen overvoltage value: 97 mV), and 0.26 (hydrogen overvoltage value: 145 mV) are shown.

Comparative Example 7

As the conductive base material, a woven mesh base material which was made by knitting a nickel fine wire having a diameter of 0.15 mm in sieve mesh size of 40 mesh was used. The base material was blasted with alumina powder having a weight average particle size of 100 μm or less. After that, the base material was subjected to an acid treatment by dipping into 6N hydrochloric acid at room temperature for 5 minutes, followed by rinsing with water and drying.

An application liquid was prepared by mixing a dinitrodiammineplatinum nitric acid solution (produced by Tanaka Kikinzoku Kogyo K.K., platinum concentration: 100 g/L) and nickel nitrate hexahydrate (produced by Tanaka Kikinzoku Kogyo K.K.) so that a molar ratio of platinum to nickel became 1:1.

A vat including the application liquid was placed in the lowest part of the coating roll, and the application liquid was impregnated into the coating rolls made of EPDM. A roll was placed above the vat so that the roll and the application liquid were in contact at any time, and another roller made of PVC was further placed above said roll. In such way, the application liquid was coated on the conductive base material. Before the application liquid dried up, the conductive base material was quickly passed between two sponge rolls made of EPDM to absorb and remove the accumulated application liquid in the intersections of the mesh of the conductive base material. Subsequently, after a coated film was formed by drying at 80° C. for 10 minutes, said coated film was subjected to calcination at 400° C. for 10 minutes using a Muffle furnace (KM-600, manufactured by Advantech Co., Ltd.) to thermally decompose said coated film. By varying the number of this cycle composed of roll coating, drying and thermal decomposition, test cathodes having different masses of catalyst layer were prepared.

Subsequently, the cathodes were subjected to electrolytic reduction in an aqueous solution of 32% by weight caustic soda, at 88° C., and at a current density of 1.0 kA/m$^2$ for 5 minutes, and after that, salt electrolysis test was carried out.

As shown in FIG. 6, the cathodes obtained in present Comparative Example did not show a low hydrogen overvoltage when used amount of platinum is less. From this, it was found that the cathode for hydrogen generation of the present invention has a high platinum utilization efficiency.

Comparative Example 8

A cathode was prepared and evaluated in the same way as in Comparative Example 7, except that the calcination was carried out at 500° C.

As shown in FIG. 6, the cathodes obtained in this Comparative Example did not show a low hydrogen overvoltage when used amount of platinum is less. From this, it was found that the cathode for hydrogen generation of the present invention has a high platinum utilization efficiency.

TABLE 1

| Example | Ir | Pt | Citric acid | Ethylene glycol | Calcination temperature (° C.) | Hydrogen overvoltage (mV) | Reverse current resistance (mg) | X-ray full width at half maximum (°) |
|---|---|---|---|---|---|---|---|---|
| 1 | 0.73 | 0.27 | 0 | 0 | 500 | 89 | 4.0 | 0.38 |
| 2 | 0.6 | 0.4 | 0 | 0 | 500 | 92 | 4.7 | 0.42 |
| 3 | 0.73 | 0.27 | 0 | 0 | 470 | 90 | 4.8 | 0.46 |
| 4 | 0.73 | 0.27 | 0.36 | 0.72 | 500 | 91 | 3.0 | 0.37 |
| 5 | 0.73 | 0.27 | 0.36 | 0.72 | 500 ($N_2$) | 92 | 1.0 | 0.39 |

TABLE 2

| Comparative Example | Ir | Pt | Ru | Citric acid | Ethylene glycol | Calcination temperature (° C.) | Hydrogen overvoltage (mV) | Reverse current resistance (mg) | X-ray full width at half maximum (°) |
|---|---|---|---|---|---|---|---|---|---|
| 1 | 0 | 1 | 0 | 0 | 0 | 500 | 84 | 7.5 | — |
| 2 | 1 | 0 | 0 | 0 | 0 | 500 | 99 | 10.6 | 0.86 |
| 3 | 0.73 | 0.27 | 0 | 0 | 0 | 400 | 89 | 13.2 | 0.82 |
| 4 | 0.73 | 0.27 | 0 | 0 | 0 | 450 | 89 | 6.7 | 0.5 |
| 5 | 0.61 | 0.39 | 0 | 0 | 0 | 450 | 90 | 6.7 | 0.49 |
| 6 | 0 | 0 | 1 | 0 | 0 | 500 | 82 | 11.5 | — |

DESCRIPTION OF REFERENCE NUMERALS

1: Diffraction peak of iridium oxide
2: Diffraction peak of metal platinum
3: Diffraction peak of metal iridium
4: Diffraction peak of iridium-platinum alloy

The invention claimed is:

1. A cathode for hydrogen generation having a conductive base material and a catalyst layer formed directly on said conductive base material, wherein said catalyst layer comprises crystalline iridium oxide, platinum and iridium-platinum alloy, wherein said conductive base material is formed of nickel, and wherein, in the X-ray diffraction measurement, said crystalline iridium oxide gives a diffraction peak which is observed in an angular region including 2θ=34.70° and has a full width at half maximum of 0.47° or less.

2. The cathode for hydrogen generation according to claim 1, wherein a ratio (Pt/(Ir+Pt)) of mole number of said platinum element to total mole number of iridium element and platinum element present in said catalyst layer is 20 to 50% by atom.

3. An electrolyzer for electrolysis of an alkali metal chloride, equipped with the cathode for hydrogen generation having a conductive base material and a catalyst layer formed on said conductive base material, wherein said catalyst layer comprises crystalline iridium oxide, platinum and iridium-platinum alloy.

4. A method for producing the cathode for hydrogen generation according to claim 1, comprising:

a coating step to apply an application liquid comprising an iridium compound and a platinum compound directly onto the conductive base material formed of nickel;

a film-forming step to form a coated film by drying said application liquid;

a thermal decomposition step to heat said coated film to decompose thermally; and an electrolyzing step to electrolyze the coated film after said thermal decomposition.

5. The method for producing the cathode for hydrogen generation according to claim 4, wherein a ratio (Pt/(Ir+Pt)) of mole number of said platinum element to a total mole number of iridium element and platinum element present in said application liquid is 20 to 50% by atom.

6. The method for producing the cathode for hydrogen generation according to claim 4, wherein a cycle composed of said coating step, said film-forming step, and said thermal decomposition step is repeated two or more times.

7. The method for producing the cathode for hydrogen generation according to claim 4, wherein, in said thermal decomposition step, said thermal decomposition is carried out at a temperature of 470° C. or higher and 600° C. or lower.

8. The method for producing the cathode for hydrogen generation according to claim 4, wherein, in said film-forming step, drying of said application liquid is carried out at a temperature of 200° C. or lower.

9. A method for producing the cathode for hydrogen generation having a conductive base material and a catalyst layer formed on said conductive base material, wherein said catalyst layer comprises crystalline iridium oxide, platinum and iridium-platinum alloy, the method comprising:

a coating step to apply an application liquid comprising an iridium compound and a platinum compound onto the conductive base material;

a film-forming step to form a coated film by drying said application liquid;

a thermal decomposition step to heat said coated film to decompose thermally; and an electrolyzing step to electrolyze the coated film after said thermal decomposition, wherein, in said thermal decomposition step, the coated film is subjected to post-heat treatment in an inert gas atmosphere after said thermal decomposition.

10. A method for producing the cathode for hydrogen generation having a conductive base material and a catalyst layer formed on said conductive base material, wherein said catalyst layer comprises crystalline iridium oxide, platinum and iridium-platinum alloy, the method comprising:

a coating step to apply an application liquid comprising an iridium compound, a platinum compound, an organic acid having a valence of two or more, and an organic compound having two or more hydroxyl groups subjected to an esterification reaction with said organic acid, onto the conductive base material;

a film-forming step to form a coated film by drying said application liquid; and a thermal decomposition step to heat said coated film to decompose thermally.

* * * * *